US005394995A

United States Patent [19]

Lusk et al.

[11] Patent Number: 5,394,995

[45] Date of Patent: Mar. 7, 1995

[54] CASCADE RUG DISPLAY

[75] Inventors: Jud Lusk, Walhalla; John G. Cheek, Anderson, both of S.C.

[73] Assignee: Orian Rugs, Inc., Anderson, S.C.

[21] Appl. No.: 179,076

[22] Filed: Jan. 10, 1994

[51] Int. Cl.[6] ..... A47F 7/00

[52] U.S. Cl. ..... 211/59.2; 211/189

[58] Field of Search ..... 211/59.2, 44, 45, 49.1, 211/60.1, 106, 189, 192

[56] References Cited

U.S. PATENT DOCUMENTS

| | | | |
|---|---|---|---|
| 349,212 | 9/1886 | Danner | 211/44 |
| 520,494 | 5/1894 | Parsons . | |
| 584,811 | 6/1887 | Caldwell . | |
| 2,891,677 | 6/1959 | Ritchie | 211/49 |
| 3,227,503 | 1/1966 | Fletcher et al. | 312/234 |
| 4,331,245 | 5/1982 | Schell | 211/45 X |
| 4,604,061 | 8/1986 | Willcocks et al. | 211/45 X |
| 5,284,257 | 2/1994 | Schum | 211/59.2 |

*Primary Examiner*—Ramon O. Ramirez
*Assistant Examiner*—Sarah L. Purol
*Attorney, Agent, or Firm*—Cort Flint; Gerald R. Boss

[57] ABSTRACT

Display apparatus is disclosed for storing and vending rolls of floor covering of different sizes and of the same design which includes a plurality of vertically stacked cantilevered racks which are inclined for storing and vending rolls in a horizontal, cascaded fashion, and a grid-like holder rack having receptacle openings which store and vend rolls in an upright and orderly manner.

30 Claims, 6 Drawing Sheets

CASCADE RUG DISPLAY

BACKGROUND OF THE INVENTION

The invention relates to an article display, and more particularly, to a display for storing and vending rolls of floor covering. The display stores and vends different size rolls having the same design be means of a plurality of vertically stacked racks which display the rolls in a horizontal cascade fashion, and a grid-like holder rack which stores and vends rolls in an upright and orderly manner.

Commercial items are displayed in retail settings primarily for attracting customer attention. Items are displayed throughout a store so that customers may view the assorted items and make a selection. In a competitive environment, the particular manner in which an item is displayed may result in one item being chosen over another item merely due to the display's appeal and the item's presentation. The effect of a commercial item's packaging and display in influencing the public to select that item is the predominate force behind advertising.

In the floor covering industry, i.e., rugs, carpet, linoleum, etc., rugs are generally displayed either horizontally laying flat or rolled up; standing either upright or lying flat. There are three primary problems which the consumer encounters when selecting a rug which is horizontally lying flat. The first problem arises in that a consumer can only see the particular pattern of the rug which is lying on the top of a group of horizontally laid rugs. Consequently should the consumer not like that particular pattern which is displayed, the consumer may not search that particular pile thinking that the pile is representative entirely of that displayed pattern. Additionally, should a consumer venture over to a pile of rugs laid out in a horizontal manner, the consumer must flip one rug after another to see the full collection of rug patterns available. The flipping of rugs from one to the other is very inconvenient to the consumer. Not only does the flipping of rugs grow progressively heavier as more rugs are flipped, but generally when one rug is just briefly leafed through only a limited view of the pattern is accessible to the consumer.

In order to solve the many problems which are encountered by the consumer in a horizontally flat rug display setting, in some situations the rugs are shown in a manner in which they are rolled up, sealed and displayed in a vertical position with a picture of the rug's pattern affixed to the packaging. This allows the consumer to view a general picture of the rug's pattern. The problem with the rolled up rug is that there is generally no stabilizer for supporting the rugs and the rugs will generally be knocked over by the consumer who is separating the rolled up rugs to view the entire selection of available rugs. Consequently, after a short period of time, most of the rolled up rugs which are being displayed end up in a horizontal fashion on the floor utilizing a large floor space for display. Should the rolled up rugs be displayed in a horizontal fashion, the consumer difficulties which arise when rugs are generally laid flat for display also exist in this particular display fashion i.e., limited viewing of the available selection and inconvenience in separating the rugs for viewing.

Furthermore, the primary difficulty in displaying rugs in a manner optimally beneficial to a consumer is that the floor spaced required to display any particular item has become increasingly expensive. Consequently, it has become increasingly difficult to effectively portray to the consumer the selections of rugs available in an eye appealing fashion whereby the consumer will be attracted to view the particular attributes of a rug in a close-up manner. Due to space constraints, only a limited number of rugs and consequently only a few patterns can be displayed. The effect is that the enticement of a consumer to inquire on the selection of rugs is mostly dependent on the appeal of the few rugs which are displayed either in a horizontal manner or rolled up and displayed vertically.

Furthermore, rugs come in a variety of assortment of sizes, patterns, and purposes. In today's world it is common for a rug of a substantial size to be purchased in combination along with a long narrow piece of carpeting called a "runner" which is complimentary to the primary rug. Therefore, the displaying of a rug along with its complimentary runner is desirable for providing the consumer with a complete representation of the selections available. Once again, the current method of having rugs laid flat or rolled up, or lying around in a disorganized manner prevents a consumer from associating a particular rug with its complementary runner and "picturing" that combination in an ascetically appeasing manner. Additionally, having rugs of different sizes complicate an orderly presentment of the rugs to the public. A display unit which can only accommodate a standard size will be unable to display patterns of that rug in other sizes.

Previously, display units have been proposed for displaying various products. For example, U.S. Pat. No. 2,891,677 illustrates a bread loaf display rack which is designed as a vending facility enabling a consumer to self serve himself bread. The rack is designed as a storage and facilitating device and not as a display rack for promoting visual attraction of a commodity to a consumer. Furthermore, U.S. Pat. No. 3,993,002 shows a merchandising system which includes shelves which extend upward in a vertical direction thus minimizing overall floor space required for the display of numerous articles, however, the particular shelving structure disclosed merely provides for the display of items in a flat manner.

Accordingly, it is an object of the present invention to provide a storage/display rack for the display of a variety of rolls of floor coverings, both in a variety of patterns and sizes in an attractive manner while minimizing actual floor space;

Also it is an object of the present invention to provide a storage/vending rack which enables the customer to easily retrieve any desired floor article covering displayed by the rack in a selfvending manner;

Furthermore, it is an object of the present invention to provide a cascade rug display which will provide for the displaying of rolls of relatively large rugs along with complimentary runners in an attractive manner while providing an efficient display in a minimal amount of floor space;

Additionally, it is an object of the present invention to provide a convertible rug display such that the display may be a free standing device or one that is convertible to a shelving unit which may be attached to a pre-existing floor display allowing for maximum flexibility in the displaying of rugs according to the retailers floor layout.

SUMMARY OF THE INVENTION

The above objectives are accomplished according to the present invention by proving a display for rolls of floor covering which display different sizes of the same designs. The display includes a main support stanchion having an upper support, and a plurality of vertically stacked racks carried by the upper support. The stacked racks include a pair of outwardly extending spaced arms for storing and vending the articles in a horizontal position and a grid-like holder rack integrally carried by the main support stanchion having an array of partitions which define a plurality of receptacle openings for holding the articles in a vertical and orderly vending position.

The plurality of vertically stacked racks have a pair of spaced apart arms interconnected with the main support stanchion for storing and displaying rugs in a cascaded, horizontal position. The grid-like holder includes a partitioned array defining receptacles for holding floor covering articles in a vertical manner. The partitions separate and support the vertically displayed articles so that the removal of one article from the array will not result in an adjacent rug being unsupported. The main support stanchion, plurality of vertically stacked racks, and vertical holder interrelate to form either a freestanding vending apparatus which may be utilized in aisles of a retail store or they may utilize brackets to be attached to an upstanding commercial display stand having receptacles for receiving the brackets.

These configurations enable an ensemble of rugs of different sizes to be displayed together in a horizontal and vertical configuration enabling the consumer to view the ensemble in a manner which will allow the consumer to make an informative decision in selecting a particular rug pattern. Additionally, these configurations enable a variety of rugs and their complimentary runners to be displayed in an orderly and appealing fashion enabling a consumer to view the full assortment of rug patterns available with minimal effort. Furthermore, the display enables a consumer to view the rug patterns available from a position which is a considerable distance away and the combination of an orderly and appealing rug display will attractively advertise the rugs to the consumer for the purpose of enticing the consumer to venture towards the rug display. the rugs to the consumer for the purpose of enticing the consumer to venture towards the rug display.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
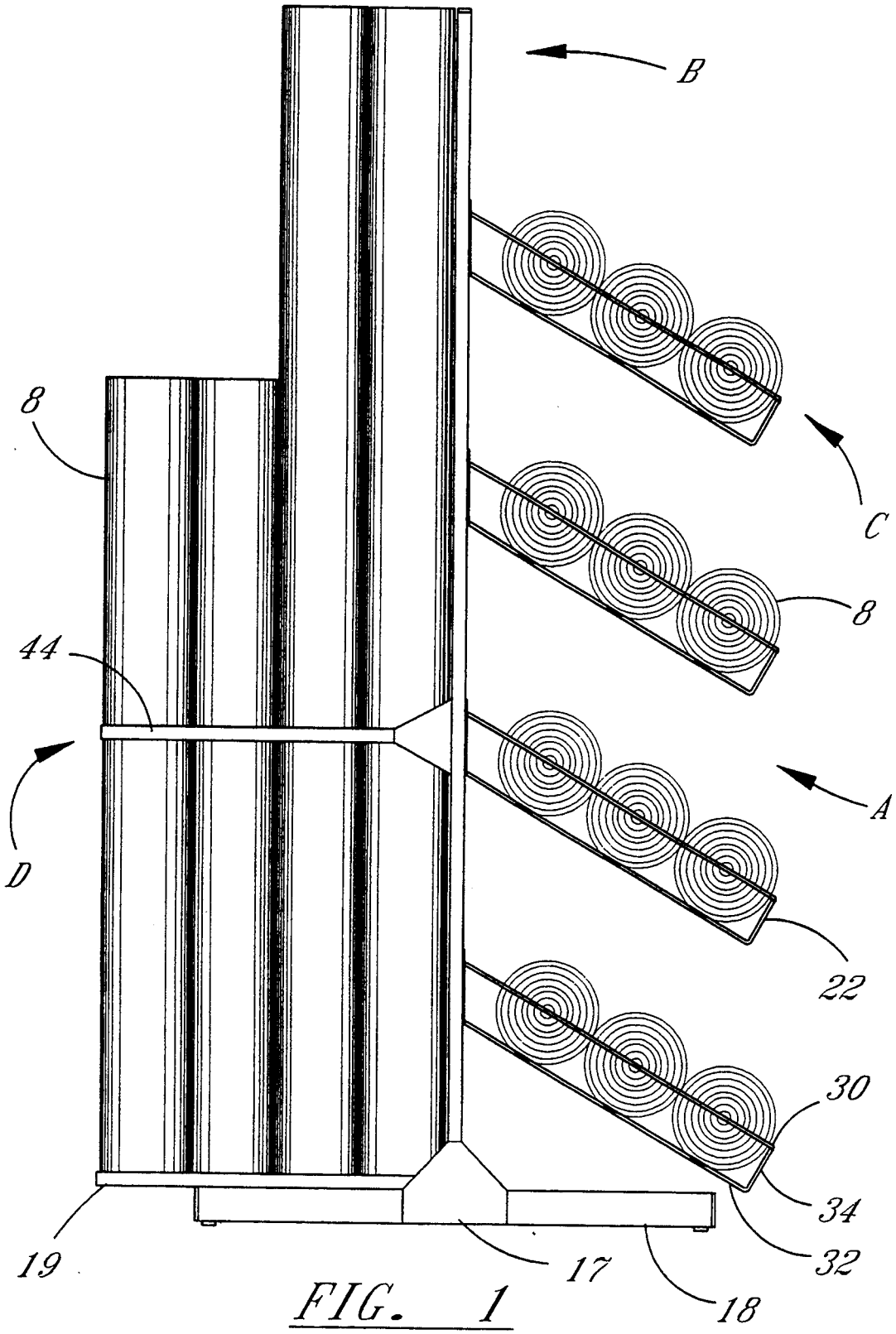
FIG. 1 s a perspective of a display rack displaying a plurality of rugs horizontally on vertically stacked racks and vertically by a grid-like holder rack according to the invention.
Figure 2:
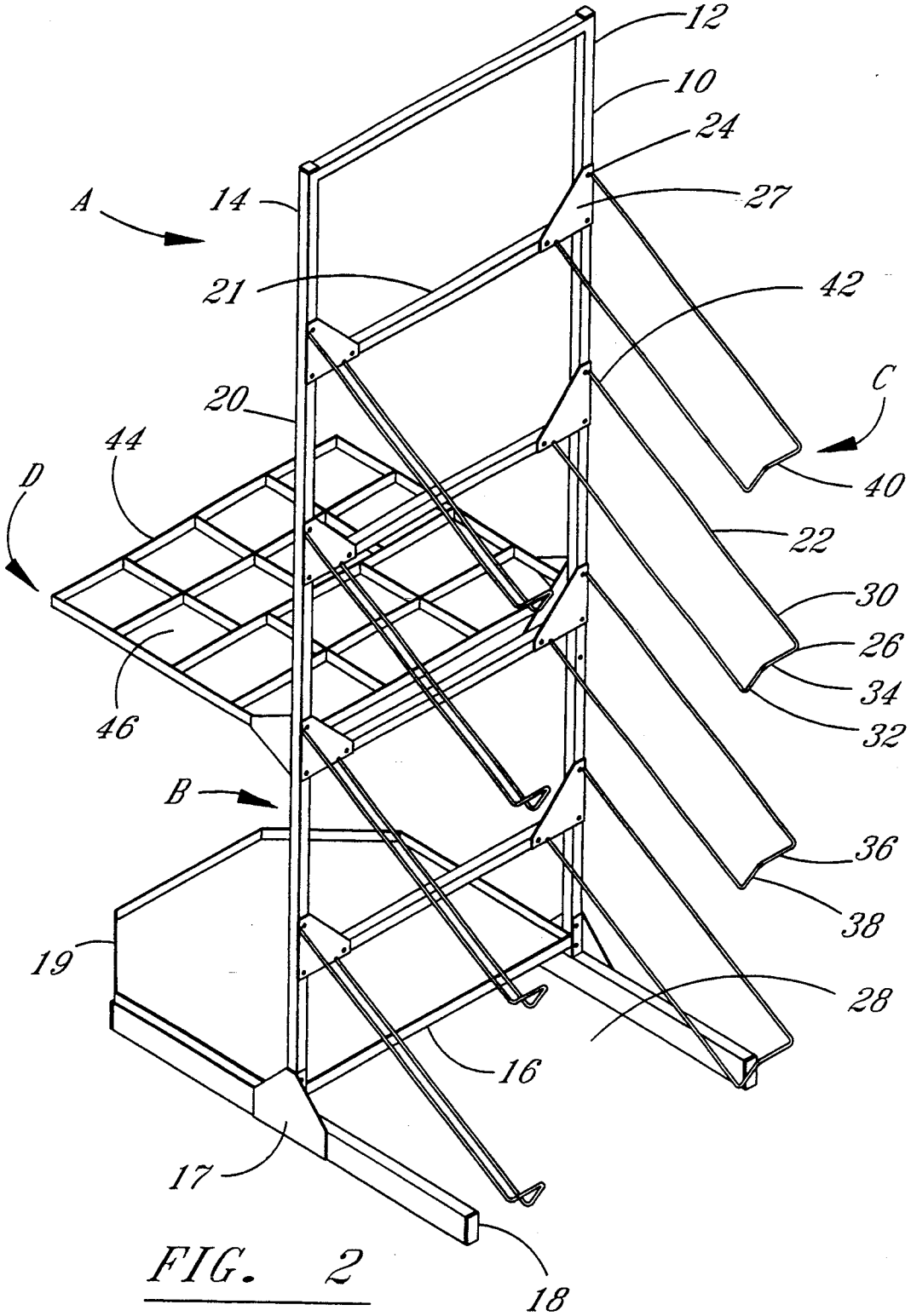
FIG. 2 is a perspective of a free standing display rack for storing and vending a plurality of rugs horizontally and vertically according to the invention.
Figure 3:
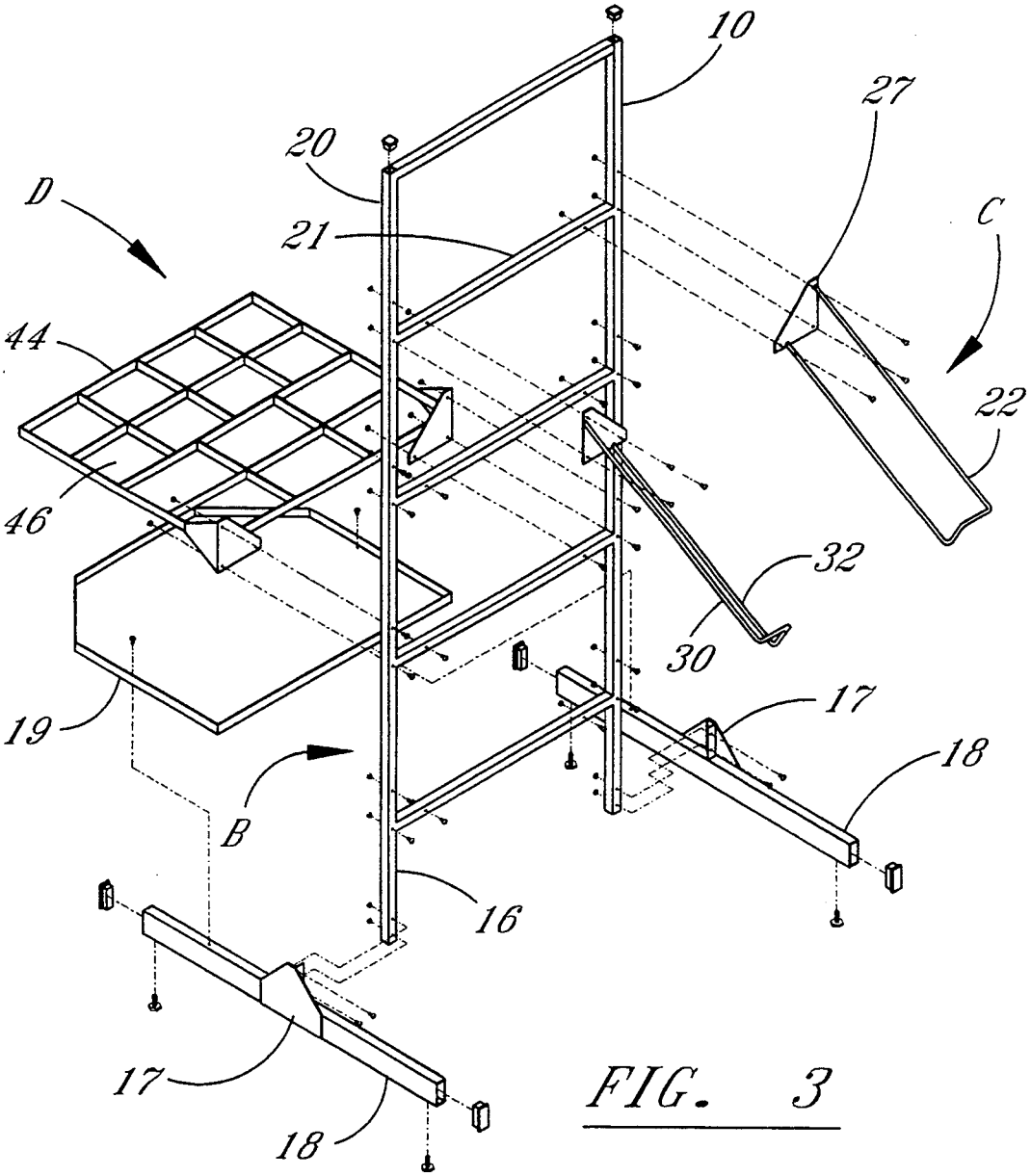
FIG. 3 is an exploded view of a free standing display rack for storing and vending a plurality of rugs horizontally and vertically according to the invention.
Figure 4:
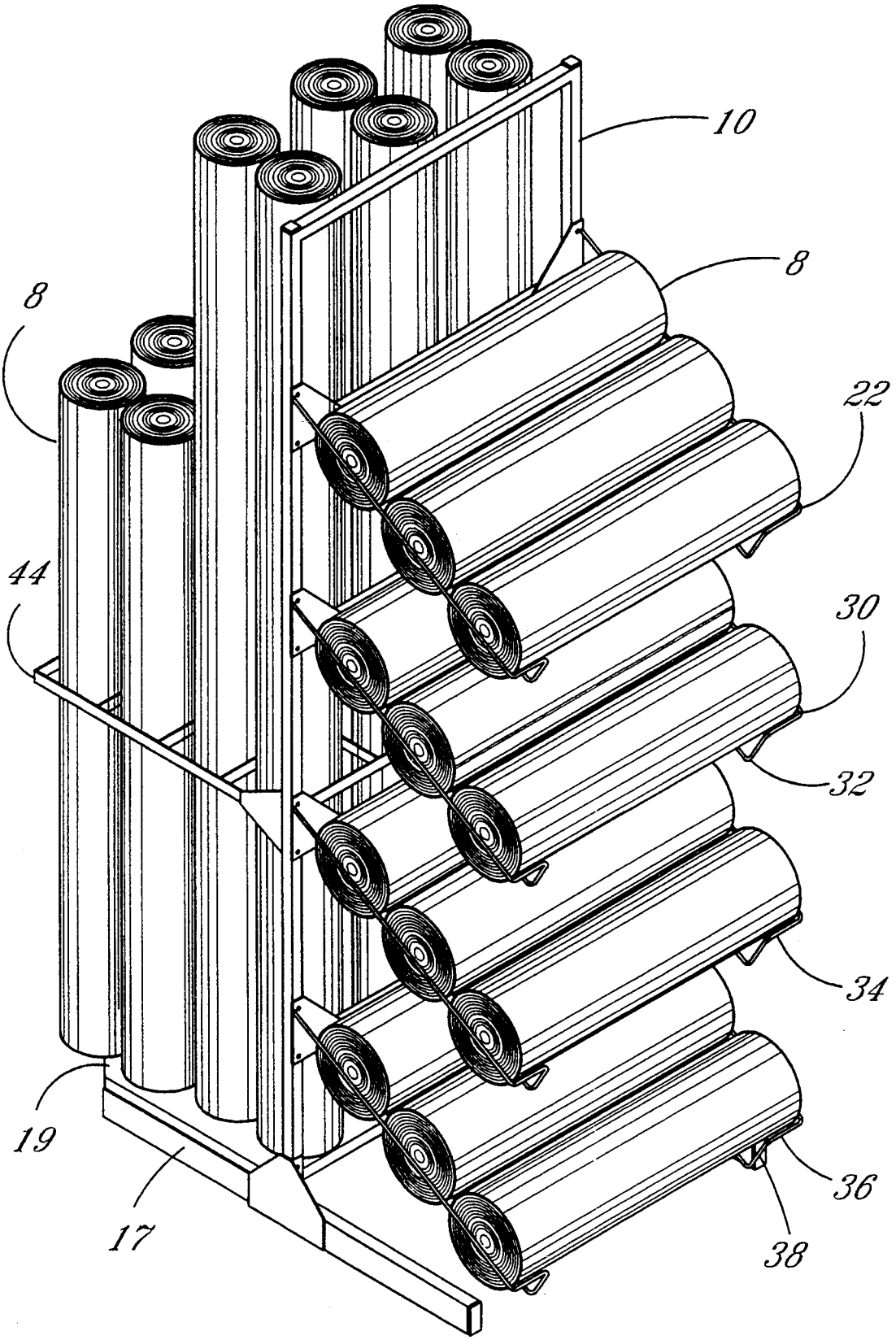
FIG. 4 is a perspective of a display rack displaying a plurality of rugs horizontally in a cascade manner on vertically stacked racks and vertically by a grid-like holder rack according to the invention.
Figure 5:
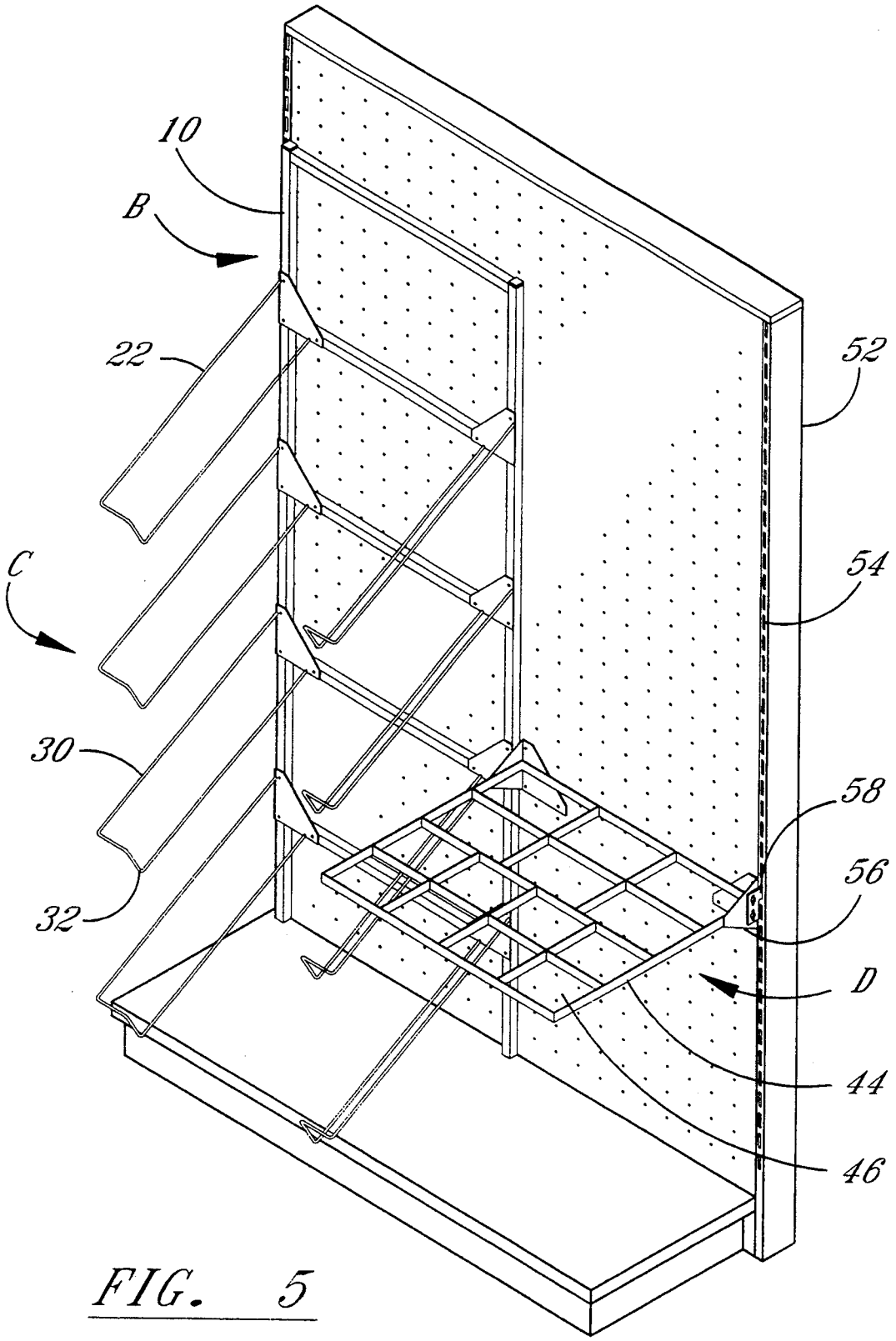
FIG. 5 is a perspective of a display rack for storing and vending a plurality of rugs horizontally and vertically in combination with an upstanding commercial display unit according to the invention.
Figure 6:
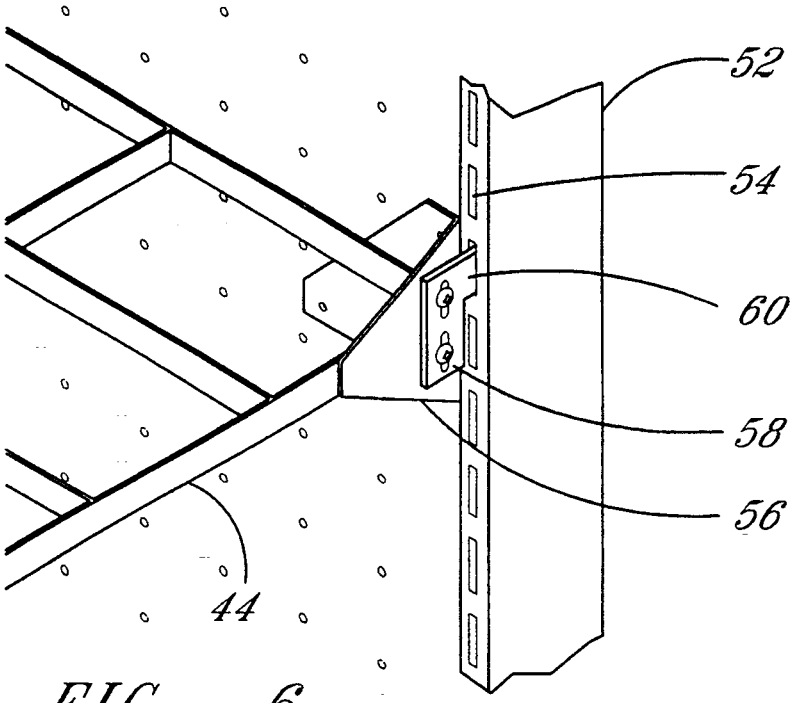
FIG. 6 is a view illustrating a grid-like holder attached to an upstanding commercial display unit according to the invention.
Figure 7:
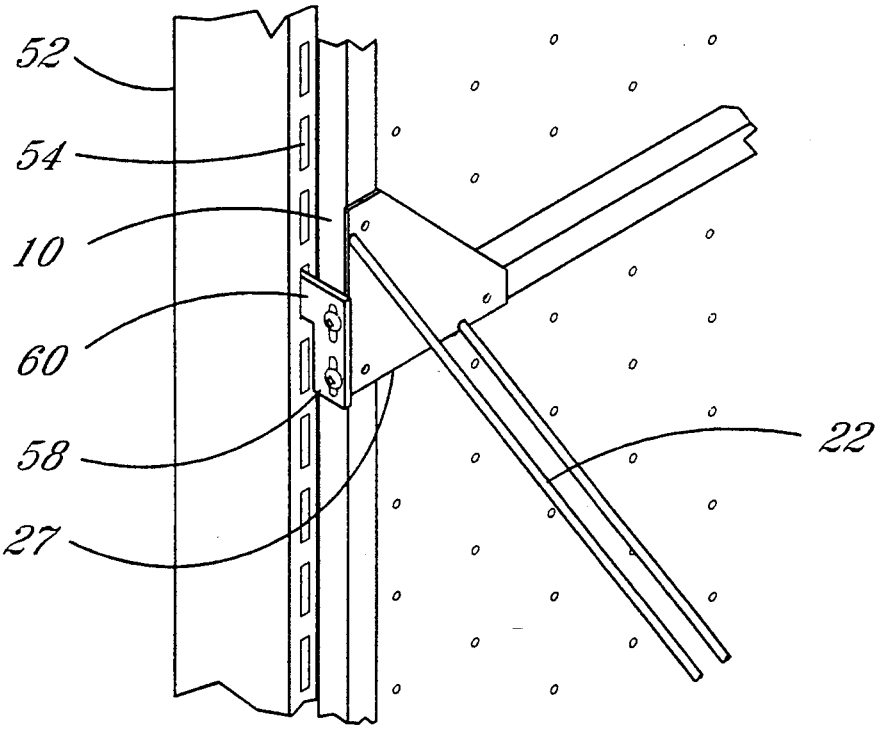
FIG. 7 is a view illustrating a display rack attached to an upstanding commercial display unit according to the invention.

Referring now in more detail to the drawings, a display for storing and vending an ensemble of floor coverings such as rugs in a horizontal and vertical combination shown in two separate configurations. FIGS. 1, 2, 3, and 4 illustrate a free standing floor covering display A and FIGS. 5, 6 and 7 illustrate a floor covering display A in combination with a an upstanding commercial display stand.

As shown in FIGS. 1, 2, 3 and 4 floor covering display A includes a main support stanchion B, vertically stacked racks C for displaying floor coverings in an horizontal position, and grid-like holder rack D integral with main support stanchion B for displaying floor coverings 8 in a vertical position. Rugs are available commercially in various sizes. Three common sizes of floor rugs are twenty-four inches wide by forty-three inches long, forty-eight inches wide by seventy-two inches long, and sixty-seven inches wide by ninety-nine inches long. In addition to the various sizes of rugs available to the consumer, rugs known as runners which are generally 24 inches wide by 96 inches long are available which compliment the floor rug. Accordingly, it is advantageous to sell stanchion B is of a sufficient height to enable rugs of various widths to be rolled and displayed in a vertical manner by grid-like holder rack D while enabling the larger main rug to be displaying a counterpart runner in a horizontal manner by vertically stacked racks C.

As shown in FIGS. 1, 2, 3 and 4, main support stanchion B extends upwardly to include an upper support 10. Upper support 10 includes a front side 12 and a back side 14. Main support stanchion B includes a base 16 with feet 18 connected to base 16 by gussets 17 enabling main support stanchion B to be free-standing. Feet 18 are the only contact with which floor covering display A or the rugs have with the floor thus enabling rug display A to be moved to any other desired location. A support plate 19 is integral with main support stanchion B and is located planarly below grid-like holder rack D. Support plate 19 enables floor coverings 8 to be displayed vertically by grid-like holder rack D while preventing floor coverings 8 from engaging in contact with the floor. This will prevent those floor coverings which are not in plastic packaging becoming dirty while being displayed.

As shown in FIGS. 1, 2, 3 and 4, upper support 10 is comprised of two vertical members 20 connected by horizontal beams 21 generally connected at right angles with vertical members 20. In the preferred embodiment main support stanchion B is of a unitary construction and includes a horizontal beam for each vertically stacked rack C plus an additional beam at the top of main support stanchion B for stability. Vertically stacked racks vertically stacked rack C plus an additional beam at the top of main support stanchion B for stability. Vertically stacked racks C are carried in a cantilevered manner by upper support 10 of main support stanchion B. Vertically stacked racks C include pairs of outwardly extending spaced arms 22 which are inclined having a cantilevered end 24 interconnected with upper support 10 and free end 26 which is suspended away from main support stanchion B. In the preferred embodiment, spaced arms 22 include a triangular arm plate 27 which is connected with vertical member 20 and horizontal beam 21 at three points in a triangular manner defining cantilevered end 24. The first connect point is on vertical member 20, the second connect point is on horizontal beam 21, and the third connect point is on vertical member 20 where horizontal beam 21 is joined.

Spaced arms 22 define a lateral space 28 which bridges spaced arms 22 enabling rolls of floor coverings 8 to be lifted by the customer from stacked racks C from a force exerted beneath the rolls for easily viewing any runner. Spaced arms 22 include an upper bar 30 and a lower bar 32 which are affixed to stanchion B at cantilevered end 24 and terminate at free end 26. Upper bar 30 and lower bar 32 interconnect to form a respective of spaced arms 22. An article retainer element 34 interconnects the respective free ends 26 of upper bar 30 and lower bar 32 for retaining rolls of floor coverings 8 on spaced arms 22. Upper bar 30 and lower bar 32 are offset horizontally and vertically providing depth for displaying floor coverings 8 in a horizontal fashion. This configuration creates a brace for retaining any rugs rolled up and displayed on spaced arms 22 from rolling off the arms. Additionally this configuration utilizes minimal material for displaying the rugs and allows more surface area of the displayed rug to be visible to a customer.

Article retainer element 34 includes a first leg 36 integral with upper bar 30 and a second leg 38 integral with lower bar 32. Rolls of floor coverings 8 are supported horizontally by lower bar 32 and prevented from rolling off spaced arms 22 by article retainer element 34. In the preferred embodiment, upper bar 30, lower bar 32, first leg 30, and second leg 38 are of a one-piece unitary construction which define bends having prescribed curvatures and first leg 30 and second leg 38 are disposed at approximately a ninety degree angle. Free end 26 of a first inclined rack 40 is of a vertical height greater then cantilevered end 24 of a second inclined rack 42 enabling rolls of floor coverings 8 stored on racks C to be viewed in a cascaded manner from a vending position which is in front of racks C when floor coverings 8 are displayed horizontally and descending on racks C. In the preferred embodiment spaced arms 22 are inclined downwardly at an angle so that the rugs displayed on the spaced arms may all be fully viewed by a customer viewing the display rack from afar. Furthermore, the combination of the plurality of vertically stack racks C create an aesthetic view of the rugs in a cascading manner. Accordingly, not only is the customer able to view the different varieties of rugs available from afar, but it is attracted to the display due to the novelty of the cascading features of the different rugs. The vertical height of first inclined rack 40 is sufficient to permit a roll of floor covering 8 to be placed in the back position of second inclined rack 42 when forward rolls are already in place on rack C.

As shown in FIGS. 1, 2, 3, and 4, grid-like holder rack D includes an array of open partitions 44 defining a plurality of receptacle passages 46 of various widths extending through partitions-44 through which rolls of floor coverings 8 of different diameters may be inserted in a generally vertical vending position for storing and vending.

As shown in FIGS. 5, 6, and 7 an embodiment for enabling a customer to view runners laid in horizontal position along with their primary rug which are stacked in a vertical configuration together in a complimentary manner may be had with utilization of an upstanding commercial stand 52 including vertically aligned receptacles 54. Grid-like holder rack D is disposed near main support stanchion B. An adapted mounting bracket 56 is attached to the side of grid-like holder rack D. A plurality of braces 58 are attached to mounting bracket 56 and to main support stanchion B for mounting these structures on upstanding commercial stand 52. Brace 58 includes a tab 60 which is received in receptacle 54. In this configuration the vertically aligned rugs are displayed side by side to a complimentary rug runner enabling a potential customer to view the complete assortment of the different varieties of rugs available to them.

Thus it may be seen that a more advantageous way of displaying rugs in an orderly and space saving manner may be had according to the invention. The cascading effect of the rugs enable a customer to view all patterns which are available for sale in an aesthetically appealing manner and may retrieve a particular desired runner easily from the display rack notwithstanding the order of which that particular rug is on the vertical rack, i.e. customer may remove the first, second or third runner with ease by exerting a force underneath the rug or by picking up the rug from the side of the runners. Furthermore the main rug which the runner compliments is illustrated in an orderly upright position in a defined partitioned area thus preventing unsightly crookedness in the display. Consequently, a particular rug may be removed from the display without inhibiting the integrity of the structure because adjacent rugs are restrained by partitions and prevented from falling in the vacated area.

Additionally, by removing contact of any rugs with the floor, the rugs are maintained in a clean retail manner and the display of free standing display unit may be moved with ease to a desired location. Additionally, should the retail outlet decide to use the rug display with a wall standing unit, the rug display with an adaptable bracket may be easily attached to the wall standing display with the use of brackets. Both embodiments utilize the floor space economically by requiring only a minimal amount of floor space for displaying a large square footage of rugs. The orderly and aesthetically appealing display of rugs in association with the economical utilization of floor space combine in a synergistic effect with the potential for commercial rug suppliers and retailers to achieve increased sales and profits in the sales of rugs by utilizing these racks.

While a preferred embodiment of the invention has been described using specific terms, such description is for illustrative purposes only, and it is to be understood that changes and variations may be made without departing from the spirit or scope of the following claims.

What is claimed is:

1. Display apparatus for storing and vending rolls of floor covering which includes different size rolls of the same designs, said apparatus comprising:

a main support stanchion extending upwardly to include an upper support;

a plurality of vertically stacked racks carried by said upper support of said main support stanchion, said racks including pairs of outwardly extending spaced arms for storing and vending said rolls in a horizontal position; and a grid-like holder rack integrally carried with said main support stanchion having an array of open partitions which defines a plurality of receptacle passages through which a roll of said floor covering may be inserted in a generally vertical vending position for said storing and vending of said rolls from said vertical vending position.

2. The apparatus of claim 1 wherein said vertically stacked racks are supported in a cantilevered manner by said main support stanchion.

3. The apparatus of claim 2 wherein said vertically stacked racks are inclined having a cantilevered end interconnected with said main support stanchion and a free end suspended at a distance from said stanchion.

4. The apparatus of claim 3 wherein said free end of a first inclined rack is of a vertical height greater than the cantilevered end of a second inclined rack enabling said rolls stored on said racks to be viewed in a cascaded manner from a vending position in front of said racks when said rolls are displayed horizontally and descending on said racks.

5. The apparatus of claim 4 wherein said vertical height of a first inclined rack is sufficient to permit a roll of said floor covering to be placed in a back position of a second of said inclined racks with forward rolls already in place on said rack.

6. The apparatus of claim 1 wherein said spaced arms of said stacked racks include upper and lower bars interconnected forming a respective one of said arm.

7. The apparatus of claim 6 wherein said upper and lower bars are affixed to said stanchion at said cantilever end and terminate at said free end of said arm.

8. The apparatus of claim 7 wherein said upper and lower bars terminate at a retainer element for retaining said rolls on said arms.

9. The apparatus of claim 8 wherein said upper and lower bars are offset horizontally and vertically and said retainer element includes a first leg integral with said upper bar, a second leg integral with said lower bar, and said first and second legs being disposed at a ninety degree angle, said rolls being supported by said lower bar and prevented from rolling off said arms by retainer element.

10. The apparatus of claim 9 wherein said upper bar, lower bar, and first and second legs are one piece.

11. The apparatus of claim 10 wherein said upper bar, lower bar, first leg, and second leg are joined together by bends having prescribed curvatures.

12. The apparatus of claim 1 wherein said spaced apart arms define a lateral space bridging said arms enabling said rolls to be lifted from said racks from a force exerted beneath said rolls.

13. The apparatus of claim 1 wherein said receptacles of said grid-like holder are of various widths for enabling rolls of different diameter to be maintained in an upright vertical manner.

14. The apparatus of claim 1 wherein said stanchion includes a pair of spaced apart feet integral with said main support stanchion for maintaining said stanchion in a free standing upright position.

15. The apparatus of claim 1 including a support plate integral with said stanchion located planarly below said grid-like holder for supporting said vertically stored articles above a floor thereby maintaining said articles free from floor contract.

16. The apparatus of claim 1 wherein said upper support stanchion includes a front side and a back side, said plurality of vertically stacked racks carried by said front side and said gridlike holder rack being carried by said back side.

17. Display apparatus for storing and vending a plurality of rolls of floor covering which may include different sizes of the same designs, said apparatus comprising:

a base for supporting said display on a floor;

a main support stanchion carried by said base in an upwardly extending manner to define an upper support, said upper support having a front side and a back side;

a plurality of inclined stacked racks carried in a vertically stacked manner by said front side of said upper support;

said inclined racks including pairs of outwardly extending spaced arms for storing and vending said rolls in a horizontal position and in a cascaded manner;

a grid-like holder rack integrally carried by said back side of said upper support having an array of partitions which defines a plurality of receptacle openings for storing and vending said rolls in a vertical vending position; and a support plate integral with said stanchion located planarly below said holder for supporting said vertically stored articles above a floor thereby maintaining said articles free from floor contact.

18. The apparatus of claim 17 wherein said vertically stacked racks are supported in a cantilevered manner by said main support stanchion.

19. The apparatus of claim 18 wherein said vertically stacked racks are inclined having a cantilevered end interconnected with said main support stanchion and a free end suspended away from said stanchion.

20. The apparatus of claim 19 wherein said free end of a first inclined rack is of a vertical height greater than the cantilevered end of a second inclined rack enabling said rolls stored on said racks to be viewed in a cascaded manner from a vending position in front of said racks when said rolls are displayed horizontally and descending on said racks.

21. The apparatus of claim 20 wherein said vertical height of a first inclined rack is sufficient to permit a roll of said floor covering to be placed in the back position of a second of said inclined racks with forward rolls already in place on said rack.

22. The apparatus of claim 17 wherein said spaced arms of said stacked racks include upper and lower bars interconnected forming a respective of said arm; and said upper and lower bars are affixed to said stanchion at said cantilever end and terminate at said free end of said arm.

23. The apparatus of claim 22 wherein said upper and lower bars are offset horizontally and vertically and terminate at a retainer element which includes a first leg integral with said upper bar, a second leg integral with said lower bar, said first and second legs being disposed at a ninety degree angle, and said rolls being supported by said lower bar and prevented from rolling off said arms by retainer element.

24. The apparatus of claim 23 wherein said upper bar, lower bar, first leg, and second leg are one piece and are joined together by bends having prescribed curvatures.

25. Display apparatus for storing and vending rolls of floor covering which may include different size rolls of the same designs in association with an upstanding commercial display stand having receptacles for receiving mounting brackets for the support of said apparatus in an upright position, said apparatus comprising:

a main support stanchion having a front side extending upwardly to include an upper support integral with said upstanding commercial display stand;

a plurality of vertically stacked, inclined racks interconnected with said front side of said main support stanchion, said inclined racks including a pair of spaced arms for horizontally storing said rolls in a cascaded manner where they may be viewed and vended one behind the other; and a grid-like holder rack disposed near said main support stanchion side by side said vertically stacked racks, said grid-like holder rack having an array of open partitions which defines a plurality of receptacle passages through which a roll of said floor covering may be inserted in a generally vertical vending position for said storing and vending of said rolls from said vertical vending position.

26. The apparatus of claim 25 wherein said vertically stacked racks are inclined having a cantilevered end interconnected with said main support stanchion and a free end suspended away from said stanchion.

27. The apparatus of claim 26 wherein said free end of a first inclined rack is of a vertical height greater than the cantilevered end of a second inclined rack enabling said rolls stored on said racks to be viewed in a cascaded manner from a vending position in front of said racks when said rolls are displayed horizontally and descending on said racks.

28. The apparatus of claim 25 wherein said spaced arms of said stacked racks include upper and lower bars which terminate at a retainer element for retaining said rolls on said arms.

29. The apparatus of claim 28 wherein said upper and lower bars are offset horizontally and vertically and said retainer element includes a first leg integral with said upper bar, a second leg integral with said lower bar, and said first and second legs being disposed at a ninety degree angle, said rolls being supported by said lower bar and prevented from rolling off said arms by retainer element.

30. The apparatus of claim 29 wherein said upper bar, lower bar, first leg and second leg are one piece and are joined together bends having prescribed curvatures.

* * * * *